US006942216B1

(12) United States Patent
Koelle

(10) Patent No.: US 6,942,216 B1
(45) Date of Patent: Sep. 13, 2005

(54) DEVICE AND METHOD FOR DISTRIBUTING A PREDETERMINED NUMBER OF SHEETS FROM A GROUP OF SHEETS PATH

(75) Inventor: Helmut Koelle, Augsburg (DE)

(73) Assignee: Bowe Systec AG, Augsburg (DE)

( * ) Notice: Subject to any disclaimer, the term of this patent is extended or adjusted under 35 U.S.C. 154(b) by 0 days.

(21) Appl. No.: 10/069,411

(22) PCT Filed: Aug. 10, 2000

(86) PCT No.: PCT/EP00/07800

§ 371 (c)(1),
(2), (4) Date: Jul. 31, 2002

(87) PCT Pub. No.: WO01/14229

PCT Pub. Date: Mar. 1, 2001

(30) Foreign Application Priority Data

Aug. 25, 1999 (DE) ..... 199 40 405

(51) Int. Cl.[7] ..... B65H 5/12

(52) U.S. Cl. ..... 271/270; 271/182; 271/267; 271/270

(58) Field of Search ..... 271/266, 182, 271/267, 270; 198/418.9, 460.3

(56) References Cited

U.S. PATENT DOCUMENTS 3,911,800 A * 10/1975 Feldkamper ..... 198/462.2
4,667,953 A * 5/1987 Hirakawa et al. ..... 271/280
4,750,732 A * 6/1988 Hara et al. ..... 271/258.02
6,328,300 B1 * 12/2001 Stefan et al. ..... 271/2
2001/0004142 A1 * 6/2001 Dorer ..... 271/3.14

OTHER PUBLICATIONS

International Preliminary Examination Report dated May 21, 2001 (in English).

* cited by examiner

*Primary Examiner*—Donald P. Walsh
*Assistant Examiner*—Kaitlin Joerger
(74) *Attorney, Agent, or Firm*—Vedder, Price, Kaufman & Kammholz, P.C.

(57) ABSTRACT

The present invention relates to a method and a device for distributing a predetermined number of sheets (410, 412, 414, 416) from a group of sheets in which a plurality of sheets is arranged in a shingled mode of arrangement in a sheet transport direction (P) in such a way that the leading edges of the sheets in the paper transport direction are spaced apart by a certain length of displacement (X), wherein the group of sheets is moved in the sheet transport direction (P) by a predetermined distance which depends on the number of sheets to be distributed and on the sheet displacement, a respective sheet constituting the leading sheet in the sheet transport direction (P) being distributed from the group of sheets as soon as the respective leading sheet has reached a distributing unit (504) as a result of the movement.

16 Claims, 10 Drawing Sheets

DEVICE AND METHOD FOR DISTRIBUTING A PREDETERMINED NUMBER OF SHEETS FROM A GROUP OF SHEETS PATH

BACKGROUND OF THE INVENTION

1. Field of the Invention

The present invention relates to a method and a device for distributing a predetermined number of sheets from a group of sheets, the group of sheets comprising a plurality of sheets which are arranged in a shingled mode of arrangement in a sheet or paper transport direction in such a way that the leading edges of the sheets in the paper transport direction are spaced apart in the group by a certain length of displacement.

2. Description of Related Art

In the prior art, paper handling systems are known in which e.g. 2-up printed sheets are supplied to a cutter, separated from one another by this cutter and then placed ready for further processing by a subsequent device. For this purpose, the 2-up printed sheets are placed one on top of the other by means of suitable machines, such as mergers, and, in this condition, they are applied to subsequent paper handling machines for further processing.

For further processing the individual sheets provided in this way, the subsequent machines take over, per machine clock cycle, one such waiting sheet; depending on the subsequent machines, individual groups must e.g. be formed from the sheets provided, these groups being then e.g. put in envelopes.

The clock cycle with which the cutter operates and with which the individual sheets are made available to the subsequent machines is faster than the clock cycle of a subsequent enveloping unit. By way of example, it is assumed that the cutter can carry out 1,000 cutting operations within a predetermined period of time, whereas the enveloping unit can carry out 100 enveloping operations within this period of time. This has the effect that, in a first case, in which the enveloping unit processes only single sheets, the cutter will be stopped at certain intervals, since it would provide too many sheets, whereas in a second case, in which the enveloping unit envelops fifteen sheets at a time, the enveloping unit will have to be stopped at certain intervals, since the cutter is not able to provide a sufficient number of sheets. The prior art already discloses solutions which, for avoiding the disadvantages resulting from the above, interpose a buffer between the cutter and the subsequent machines so as to permit a continuous operation of the cutter. In this case, the individual sheets discharged by the cutter are introduced in the buffer, and, when a predetermined number of sheets has been reached, switching over to e.g. a second buffer plane is effected so that the sheets contained in the first buffer plane can be advanced for further processing, whereas sheets discharged by the cutter are simultaneously introduced in the second buffer. Such a device is described e.g. in U.S. Pat. No. 5,083,769.

Devices of this type are, however, disadvantageous insofar as the transfer of the sheets which are discharged by the cutters and which have been merged by the merger takes too much time, since the individual sheets must be transferred to the buffer one after the other. When the sheets are provided in pairs, two sheets at a time can be transferred in parallel. In the case of large groups two sheets at a time are transferred in parallel, the respective pairs of sheets being transferred in succession. Furthermore, the performance will be impaired in the case of comparatively large buffers or uneven numbers of sheets or group sizes or in the case of even numbers of sheets and a discharge which does not take place in pairs, since, for forming a group, such systems need two or more clock cycles depending on the number of sheets.

DE 197 43 020 A1 describes a device for singulating printed products provided in the form of a succession of printed products overlapping one another in a shingle-like manner. The leading printed product in the "shingled stream" is seized and advanced at a higher speed in the singulating device so that a distance to the following printed products is established, whereby the desired singulating effect is produced. Instead of complete singulating, it is also possible to change the degree of overlapping of the shingled stream by means of suitable control. Formation of a group comprising a plurality of sheets is not possible.

German-Offenlegungsschrift 2 207 175 shows a device for forming stacks. A first conveying belt has individual sheets supplied thereto in a clocked mode; depending on the clock, these sheets are deposited in a shingled mode of arrangement on the first section of the conveying belt. A removing mechanism is moved via a carriage and an oscillating movement of the carriage is provided so that, during the whole advance movement of the carriage, not a single copy will be removed and deposited on a further conveying belt moving at a higher speed and so that, during the return movement of the carriage, copies seized by a roll are supplied to the collecting magazine at a higher speed. This has the effect that a gap is formed in the continued transport on the conveying belt.

SUMMARY OF THE INVENTION

It is the object of the present invention to provide a method and a device which support a simple and a faster formation of groups with a minimum number of necessary machine clock cycles in paper handling systems.

The present invention is a method for distributing a predetermined number of sheets from a group of sheets, the group of sheets comprising a plurality of sheets which are arranged in a shingled mode of arrangement in a sheet transport direction in such a way that leading edges of the sheets in the sheet transport direction are spaced apart in the group by a certain length of displacement. In the method the group of sheets is moved in the sheet transport direction by a predetermined distance which depends on the number of sheets to be distributed and on the sheet displacement, wherein a respective sheet constituting the leading sheet in the sheet transport direction is distributed from the group of sheets as soon as the respective leading sheet has reached a distributing unit as a result of the movement, the distributing unit being driven continuously at least during the movement of the group.

The present invention is a device for distributing a predetermined number of sheets from a group of sheets from a sheet handling machine, the group of sheets comprising a plurality of sheets which are arranged in a first transport unit in a shingled mode of arrangement in a sheet transport direction in such a way that leading edges of the sheets in the sheet transport direction are spaced apart in the group by a certain length of displacement, wherein the transport unit moves the group of sheets in the sheet transport direction by a predetermined distance in the direction of a distributing unit, the predetermined distance depending on the number of sheets to be distributed and on the sheet displacement, and wherein the distributing unit is continuously driven at least as long as the group of sheets is being moved by the transport unit, and wherein the distributing unit distributes from the group of sheets a respective leading sheet in the sheet trans-port direction as soon as the respective leading sheet has reached the distributing unit as a result of the movement.

The present invention is based on the finding that the above-described disadvantages in the prior art can be overcome by the way in which the sheets to be processed are distributed in accordance with the present invention, since the 2-up printed sheets which are superimposed with a small displacement in the longitudinal direction (pre-shingled) can easily be separated from one another.

Comparatively large groups can be formed in a simple way by forming a comparatively large shingled stream with additional sheets which have already been pre-shingled. The machines known in the prior art do not permit this course of action, but they only permit a formation of the shingled stream with individual sheets or with non-displaced 2-ups (two sheets arranged adjacent each other with the printed text facing upwards/downwards). In comparison with this prior art, the present invention is advantageous insofar as a predetermined number of sheets can easily be distributed in the form of a group by slightly increasing the duration of the clock cycle.

According to one embodiment, the first speed is equal to the third speed.

According to an embodiment of the present invention, a transport unit is provided in which the sheets are deposited in a shingled mode of arrangement. Depending on the number of sheets to be distributed, the transport unit moves the shingled stream in a clocked mode so that this shingled stream is moved towards a distributing unit, the respective leading sheet in the paper transport direction being discharged from the paper handling machine at the distributing unit. By means of this implementation, a predetermined number of sheets can easily be distributed in the form of a group by slightly increasing the duration of the clock cycle.

According to a preferred embodiment of the present invention, the transport unit is preceded by a further transport unit in which sheets are continuously collected and deposited in a shingled mode of arrangement; when a predetermined number of sheets has been reached, they are transferred to the transport unit. In the case of this embodiment, at least two sheets, which are already arranged in a shingled mode of arrangement, are transferred to a paper handling machine in one clock cycle, without these pre-shingled sheets sliding over one another, as would have been the case in the prior art. This is achieved by decelerating the leading sheet at the leading edge and the trailing sheet at the trailing edge. On the basis of this continuous feed of the merged sheets, a high increase in performance is achieved. A method permitting the provision of at least two sheets in a shingled mode of arrangement is described in DE 199 35 186 A.

In accordance with a further advantage, the present invention permits a paper handling machine to be operated with medium-sized groups, the number of sheets per group lying between the above-mentioned limits at which a preceding machine (e.g. a cutter) or a subsequent machine (e.g. an enveloping unit) has to be stopped.

Other preferred further developments f the present invention are defined in the subclaims.

In the following, preferred embodiments of the present invention will be described in detail making reference to the drawings enclosed, in which.

Figure 3:
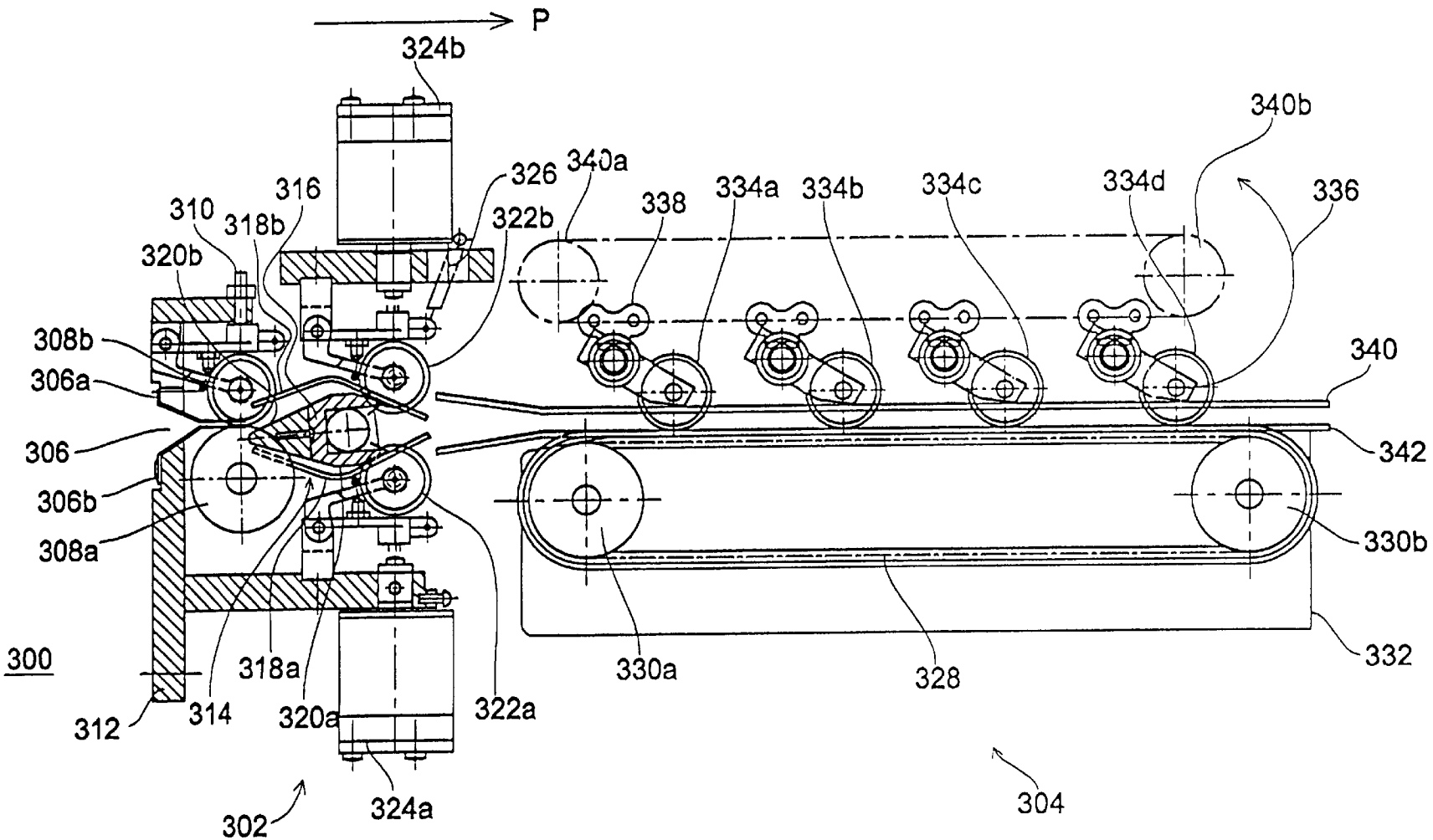
FIG. 3 shows a side view of the second section of the paper handling machine.
Figure 5:
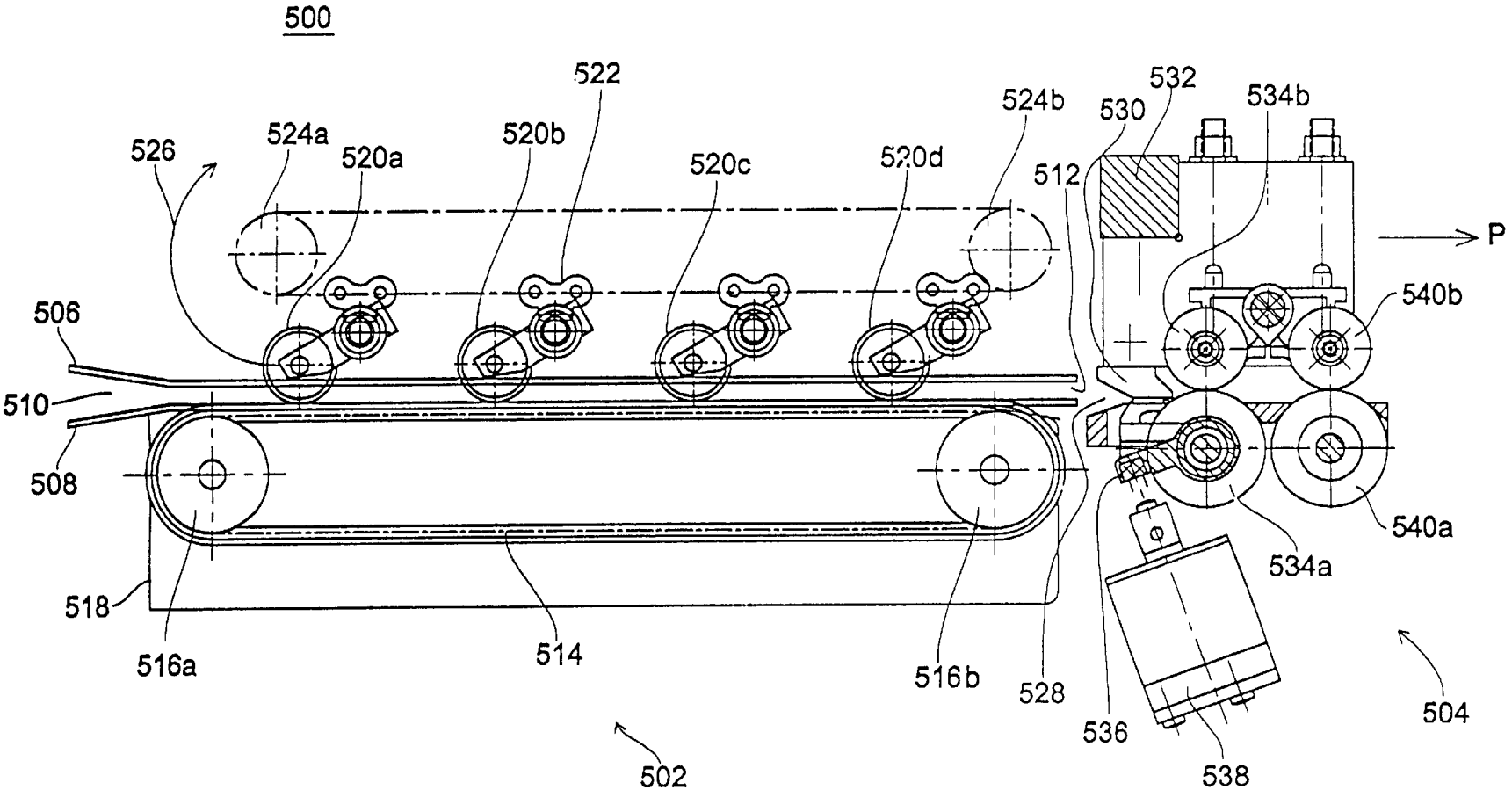
FIG. 5 shows a side view of the first section of the paper handling machine which implements a first embodiment of the device according to the present invention.
Figure 6A:
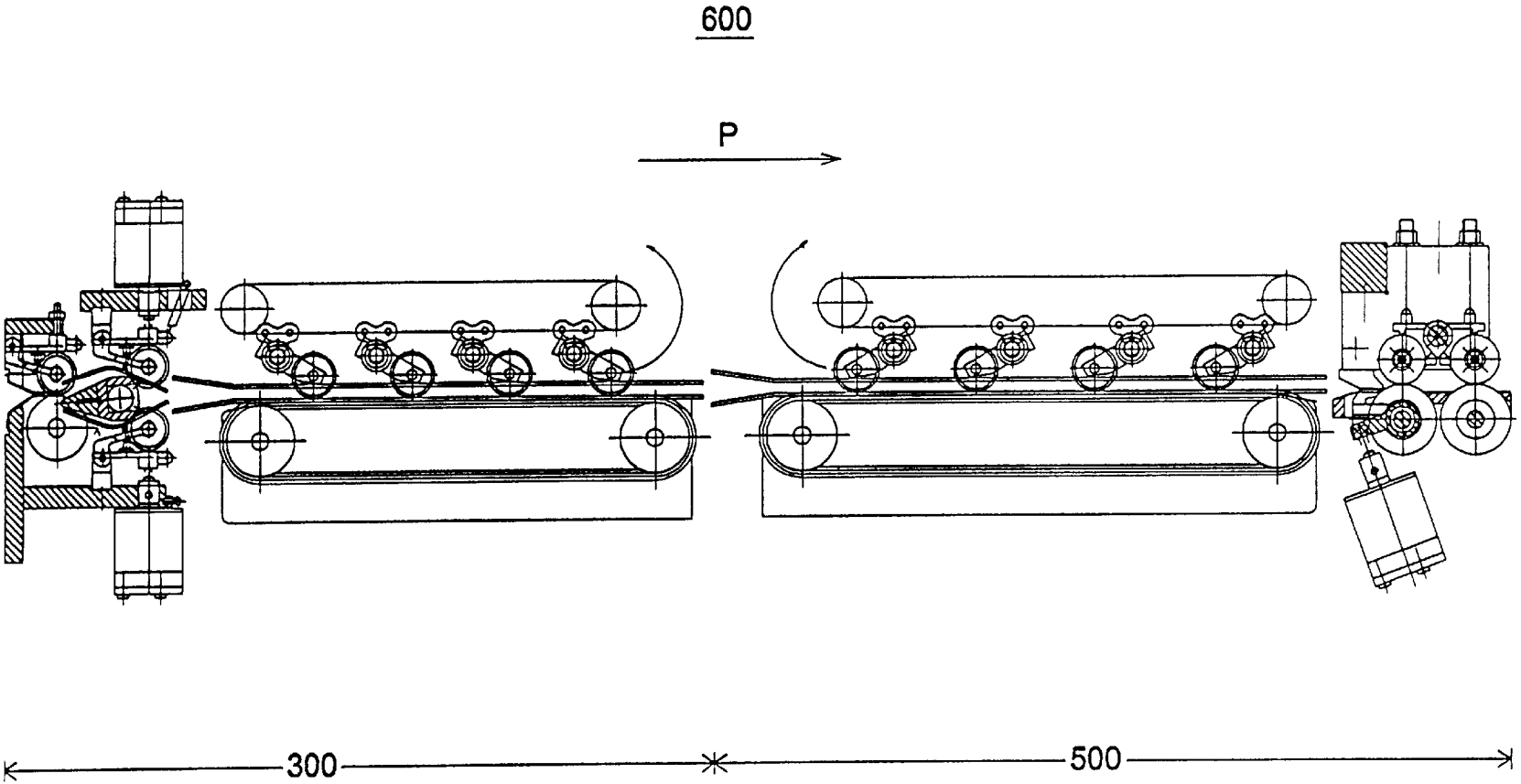
Figure 6B:
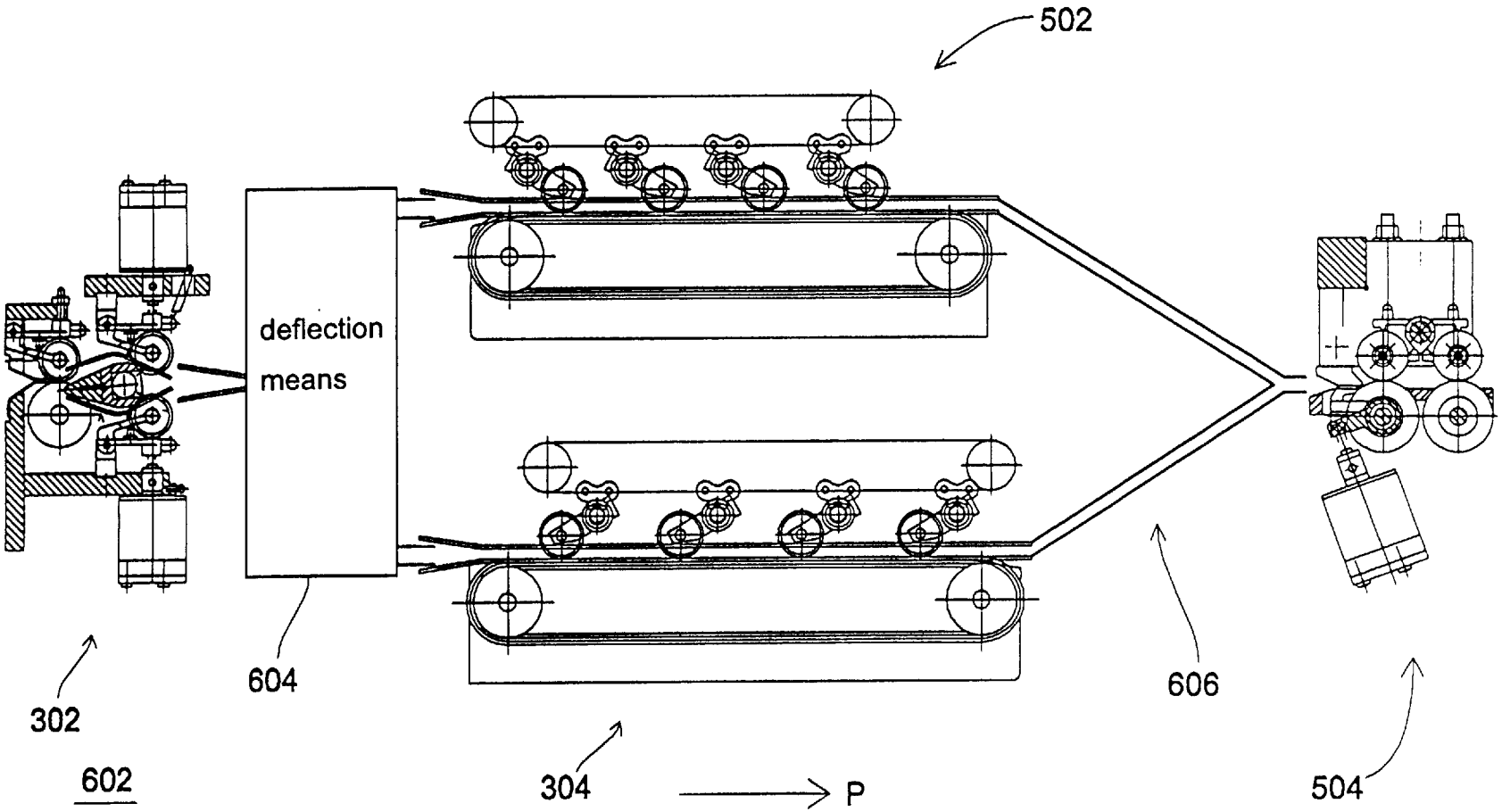

FIGS. 6A–B shows a side view of the paper handling machine comprising the sections shown in FIGS. 3 and 5; and FIGS. 7A–7D show examples of the transport units in the paper handling machine according to FIG. 6.

The description following hereinbelow refers to a paper handling system in which the device according to the present invention and the method according to the present invention are implemented. With regard to the individual figures, reference is made to the fact that identical elements or elements producing the same effect are provided with identical reference numerals in these figures.

Figure 1:
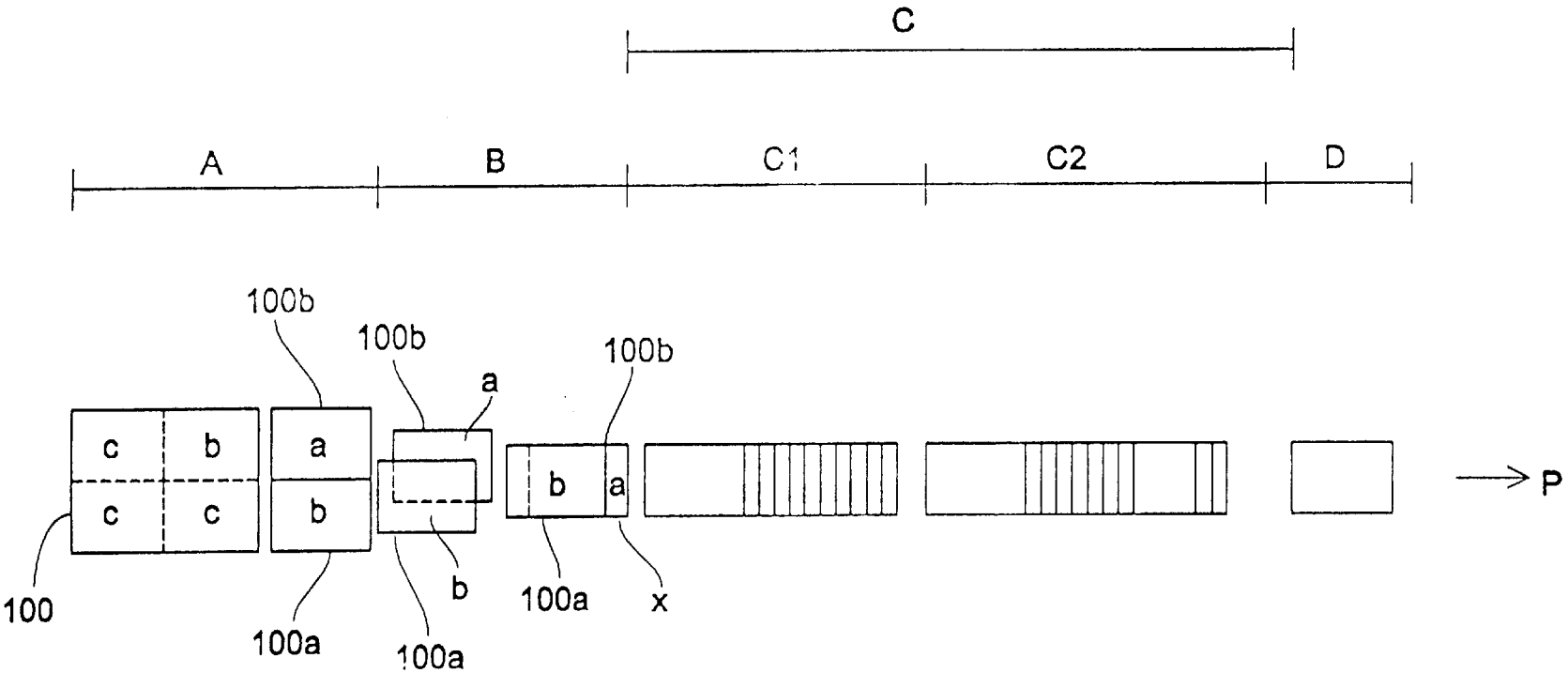
FIG. 1 shows a schematic representation of a paper handling system in which the present invention is implemented.

FIG. 1 shows in a schematic representation an example of a paper handling system comprising substantially four separate sections A–D.

In section A of the paper handling system, 2-up printed sheets 100 are supplied to a cutter and the paper web is cut longitudinally and transversely so as to obtain the individual sheets 100*a* and 100*b* which are merged in section B by means of a merger such that the sheets 100*a* and 100*b* are arranged in a shingled mode of arrangement, i.e. they are displaced by a predetermined length (shingle length) X in a sheet or paper transport direction P. From the merger section B, the two shingled sheets 100*a* and 100*b* are transferred to section C where the sheets supplied are stored intermediately before they are advanced in section D, e.g. to a collecting station.

Section C is divided into sections C1 and C2, section C1 representing a section which is part of the sheet and paper handling machine and which will be described in detail hereinbelow on the basis of FIG. 3. Also section C2 represents a section which is part of the paper handling machine and which will be described hereinbelow in more detail on the basis of FIG. 5. Section C represents in its entirety the paper handling machine which will be described later on making reference to FIG. 6.

In section C1 the shingled sheets 100*a* and 100*b* are supplied continuously until a predetermined number has been reached, whereupon the shingled stream thus formed is transferred in a single clock cycle to section C2 from which individual sheets or groups of sheets are transferred to the collecting station in a clocked mode, as will be described in detail hereinbelow.

FIG. 1 shows exemplarily in sections A and B how individual sheets or groups of sheets are arranged in the 2-ups. Sheets belonging to the same group are designated by the same minuscules. Group a comprises only one sheet, group b comprises two sheets and group c comprises three sheets.

As will be described later on with reference to the following figures, the present invention permits a very simple transfer of shingled sheets to section C and the distribution of the sheets in groups to the subsequent processing machines D.

Making reference to the figures following hereinbelow, an exemplary paper handling machine will be described in which the present invention is implemented. In the description following hereinbelow, the individual components of the machine shown in FIGS. 3 and 5 are described first, the mode of operation of the machine being schematically explained in advance on the basis of FIGS. 2 and 4.

As has already been stated hereinbefore, the present invention starts from sheets which have already been arranged in a shingled mode of arrangement; to make things easier, it will first be assumed in the description following hereinbelow that only two shingled sheets have to be transferred.

In FIG. 2, a method of transferring shingled sheets is described quite generally; for the sake of simplicity, it is first assumed that only two shingled sheets have to be transferred.

Figure 2A:
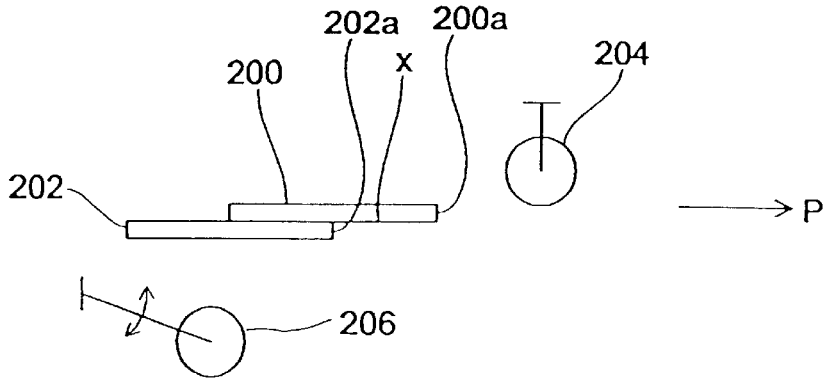
FIGS. 2A–2E show a schematic representation of the mode of operation of a first section of a paper handling machine.

FIG. 2A shows, schematically, a situation in which a first sheet 200 and a second sheet 202 are supplied in a paper or sheet transport direction to a paper handling machine, which is not shown in detail. As can be seen, the first sheet 200 and the second sheet 202 are arranged such that they are displaced relative to one another in the paper transport direction P by the length of displacement X which has already been described, i.e. they have a shingle length X which is 20 mm in the case of a preferred embodiment, but which can be in the range of from 10 mm to 50 mm.

The length of displacement X and the shingle length X, respectively, are defined by the distance between the edge 200*a* of the first sheet 200, which is the leading edge in the paper transport direction P, and the edge 202*a* of the second sheet, which is the leading edge in the paper transport direction P.

In addition, FIG. 2A shows schematically a first shingle roll 204, which is fixedly arranged with respect to the sheets 200 and 202. The shingle roll 204 is a constituent part of a first transport unit which will be described in more detail in the following figures. Furthermore, a brake roll 206 is schematically shown, which is movable between a first position and a second position with respect to the sheets 200 and 202; in FIG. 2A, the brake roll 206 occupies its first position at which it is not in engagement with the sheets 200 and 202.

The sheets 200 and 202 are supplied at a first speed by means of a feed device which is not shown in FIG. 2; according to a preferred embodiment, this first speed is approx. 3 m/s, but it may also be in the range of from 2 m/s to 3 m/s.

Figure 2B:
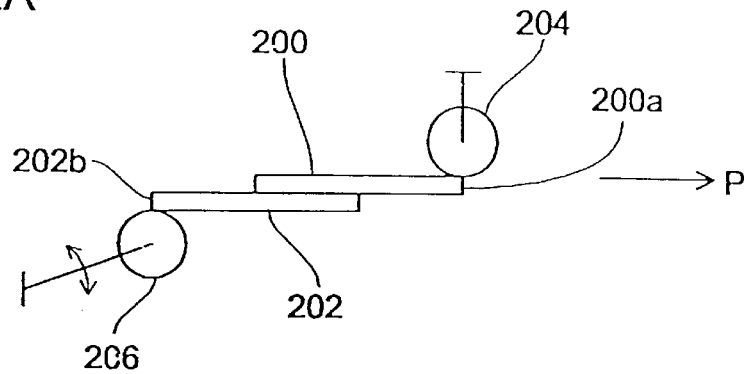

In FIG. 2B, the situation is shown in which the first sheet 200 or, to be precise, the edge 200*a* of this first sheet has reached the shingle roll 204. As has already been mentioned, the shingle roll 204 is a part of the transport unit which will be described hereinbelow and which moves the sheets that have been taken up thereby or transferred thereto at a speed of preferably approx. 0.25 m/s; this speed may, however, range of from 0.2 m/s to 2 m/s. The first speed or transport speed [$V_1$] depends on the height of the printed sheet [VH], i.e. on the format length in the paper transport direction P, the shingle length X and the second speed or supply speed [$V_2(V_1=f(VH,X,V_2))$].

When the sheets 200, 202 reach the shingle roll 204, their supply speed is decelerated, and, for preventing the two sheets 200 and 202 from sliding over one another, the brake roll 206 is switched over from its first position shown in FIG. 2A to the position shown in FIG. 2B at which the brake roll 206 engages the edge 202*b* of the second sheet 202 which is the trailing edge in the paper transport direction, and decelerates this edge so that the shingled arrangement of the two sheets 200 and 202 is maintained. The brake roll causes the second sheet 202 to be decelerated to a speed of approx. 2 m/s, but this speed may also be in the range of from 0.2 m/s to 2 m/s. The brake roll 206 is switched over as soon as the first sheet 200 has reached the shingle roll 204. According to a first embodiment, the first speed (supply speed) corresponds to the third speed (deceleration speed). This situation is preferred, since an ideal behaviour during the transfer operation will be obtained in this case. The shingle length of the transferred sheets corresponds, in this case, to the shingle length of the sheets applied to the device.

The transport unit used for advancing the transferred sheets is driven continuously and, when the two sheets have reached the first shingle roll 204, they are advanced by a distance which corresponds to the number of sheets multiplied by the shingle length X.

Figure 2C:
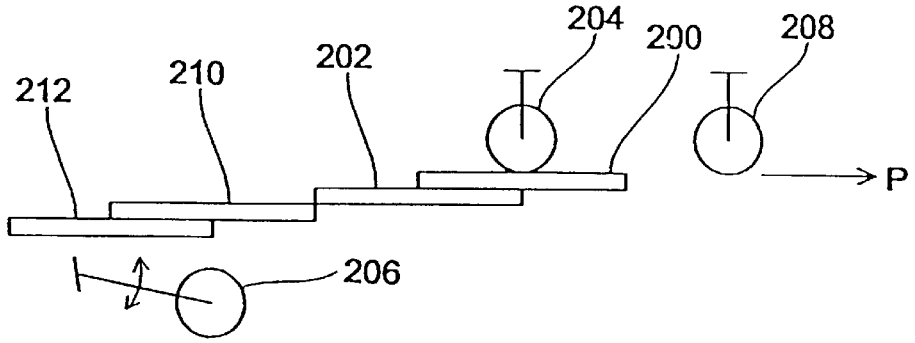

In FIG. 2C, this situation is shown together with the introduction of further sheets in the paper handling machine. The sheets 200 and 200*a* have already been moved by a first part of the distance between the first shingle roll 204 and a second shingle roll 208, the distance between the two shingle rolls 204 and 208 corresponding to the number of sheets multiplied by the shingle length. Depending on the length of displacement or shingle length X of the sheets to be introduced and transferred, respectively, the shingle rolls are arranged such that they are appropriately adjustable so as to be able to handle different formats. The distance between the rolls is smaller than the smallest possible height of the printed sheet (format length or length of a sheet measured in the paper transport direction). In the case of a format length of 3.5" (8.89 cm) the distance will be 3" (7.62 cm) so that the sheet will reliably be seized by the next roll when the transport is being continued.

Furthermore, two additional sheets 210 and 212 have been supplied and since these sheets have not yet arrived in the area of the shingle roll 204, the brake roll 206 is located at its first position where an engagement with the sheets does not take place.

Figure 2D:
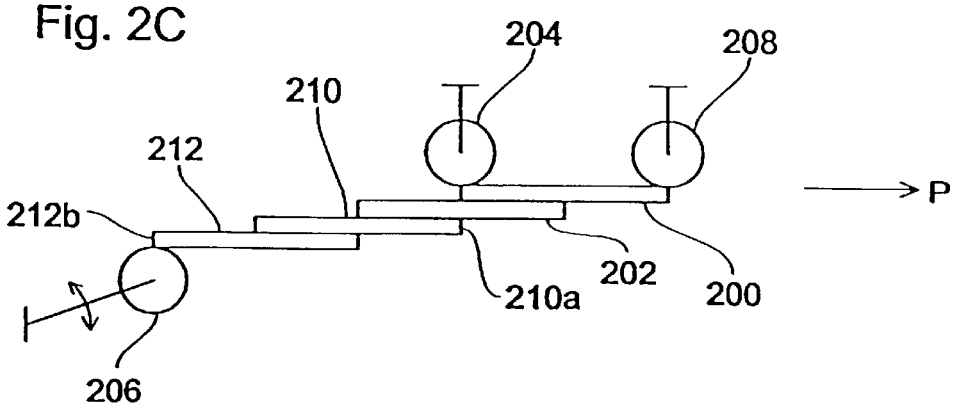

In FIG. 2D, the sheets 200 and 202 have been advanced starting from the situation shown in FIG. 2C so that sheet 200 is now applied to the shingle roll 208. The new sheet 210 reaches with the edge 210*a* representing the leading edge in the paper transport direction the first shingle roll 204 where it is decelerated, and the brake roll 206 is actuated simultaneously; the brake roll 206 is switched from its first to its second position for engaging an edge 212*b* of the second sheet 212 representing the trailing edge in the paper transport direction so as to decelerate this sheet in the way which has already been described hereinbefore, whereby the new sheets 210 and 212 will be prevented from sliding over one another.

Figure 2E:
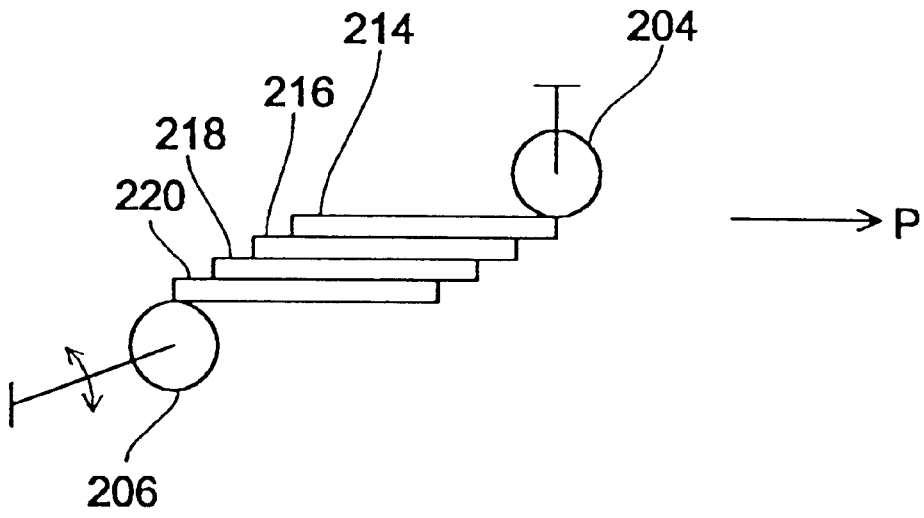

FIG. 2E shows a further example in the case of which four sheets 214, 216, 218, 220 are supplied instead of the hitherto described two sheets. FIG. 2E shows the situation in which sheet 214 has already arrived at the shingle roll 204 so that the sheets supplied are decelerated. In order to prevent the rest of the sheets 216, 218 and 220 from sliding over one another, the brake roll 206 was moved to the second position shown in FIG. 2E at the moment at which the first sheet 214 reached the shingle roll 204, so that a decelerating effect is exerted on the sheets 216–220 so as to prevent a displacement of these sheets.

FIG. 3 shows a first section of the paper handling machine.

The section of the device shown in FIG. 3 is designated generally by reference numeral 300. Section 300 comprises an inlet section 302 as well as transport unit 304.

The inlet section 302 comprises an inlet 306 which is defined by two guide means 306*a* and 306*b* converging in the paper transport direction P and which serves to feed the at least two sheets in the paper transport direction P to the section 300. A pair of feed rolls 308*a*, 308*b* is arranged in the vicinity of the ends of the guide means 306*a* and 306*b* constituting the front ends in the paper transport direction P, the feed roll 308*a* being driven by a motor which is not shown in FIG. 3. The contact force between the rolls 308*a* and 308*b* can be adjusted via an adjustment screw 310 by means of which the position of the roll 308*b* relative to the roll 308*a* can be changed. The rolls 308*a* and 308*b* are secured to a frame 312 of the inlet section 302. The feed rolls 308*a* and 308*b* are driven such that sheets supplied are moved at a speed of 2 m/s to 6 m/s, preferably 3 m/s.

The feed rolls 308*a* and 308*b* are followed by an optional trap 314 in the case of the embodiment shown in FIG. 3. The trap 314 comprises a deflection element 316 as well as two deflection guide means 318*a* and 318*b* arranged adjacent the deflection element. The deflection means 316 can be switched over between the position shown in FIG. 3, in which the pointed end of the deflection means 316 which constitutes the rear end in the paper transport direction is arranged in the vicinity of the feed roll 308*a*, and a second position in which the pointed end of the deflection means 316 which constitutes the rear end in the paper transport direction is shown in the vicinity of the roll 308*b*. Depending on the position of the deflection means, a first sheet path 320*a* and a second sheet path 320*b* are defined by the deflection means 316 and the respective deflection guide means 318*a* and 318*b*, the sheets supplied being moved along the respective sheet path in the direction of the transport unit 304. The trap 314 permits the supplied "dual sheets" to be moved in the direction of the transport unit 304, shingled selectively in an ascending or descending mode, depending on the respective position of the trap.

Each of the sheet paths 320*a* and 320*b* has associated therewith a brake roll 323*a* and 323*b*. By actuating a magnetic positioning element 324*a* and 324*b*, the respective brake roll 322*a* and 322*b* is moved from its first position in which engagement with the sheets supplied via the sheet paths does not take place to its second position in which engagement with the respective trailing edge of the second sheet of the sheets supplied takes place so as to decelerate this second sheet. The two brake rolls 322*a* and 322*b* are driven by a motor, which is not shown in FIG. 3, the deceleration speed being in the range of from 0.2 m/s to 2 m/s, preferably around 2 m/s.

When the activation of the positioning element 324*a* has been terminated, the brake roll 322*a* is returned to its first position by the force of gravity, whereas the roll 322*b* is returned to its position of rest or first position by the restoring force of a spring 326, when the activation of the positioning element 324*b* has been terminated. In the case of another embodiment, where the force of gravity does not suffice to move back the brake roll 322*a* within a sufficiently short period of time, this brake roll has also associated therewith a spring.

The first transport unit 304, which forms a buffer for receiving therein a plurality of "dual sheets" in which these sheets are accommodated in a shingled mode of arrangement, comprises a conveying belt 328 which is driven continuously, if possible, and which extends over two guide pulleys 330*a* and 330*b*, the conveying belt 328 being driven via a motor, which is not shown in FIG. 3, at a continuous speed which ranges from 0.2 m/s to 2 m/s and which is preferably approx. 0.25 m/s ($v_1$=f (VH,X,$v_2$)). The pulleys 330*a* and 330*b* are supported in a frame 332, which is schematically shown in FIG. 3. Furthermore, four shingle rolls 334*a*–334*d* are provided, which are arranged in contact with the conveying belt 328 and which are spaced apart by a distance that depends on the number of simultaneously supplied sheets and on the displacement of the sheets. The individual shingle rolls 334*a*–334*d* are movably (cf. arrow 336) secured to a chain 338, which is schematically shown in FIG. 3. The schematically shown chain is guided over transport pulleys 340*a* and 340*b* which are schematically shown as well. The chain, in combination with the shingle rolls, serves to adjust the transport unit 304 to specific formats of the sheets. The transport unit described is shown only schematically and it is obvious that the number of rolls and the distance between the rolls depends on the sheets and sheet formats (heights of the printed sheets) used and on the number of sheets to be accommodated. In the figure, an example is shown in which the rolls are spaced apart by 3" (7.62 cm).

The transport unit 304 additionally comprises two guide means 342 and 344, which are arranged in parallel and which extend along the whole transport unit 304, so that the dual sheets can reliably be transferred from the inlet 302.

The mode of operation of section 300 is such that the dual sheets are supplied via the inlet 306 and, as soon as the first sheet of the dual sheets has reached the first shingle roll 334*a*, the dual sheets are decelerated and, in order to prevent the sheets from sliding over one another, one of the brake rolls 322*a* and 322*b*, respectively, is activated, at the moment at which a leading edge of the first sheet reaches the shingle roll 334*a*, by actuating the respective positioning element so as to engage a trailing edge of the second sheet of the dual sheets so that the sheets will be prevented from sliding over one another. Subsequently, the sheets are advanced by the transport unit 304; in so doing, additional dual sheets are simultaneously supplied until a predetermined number of dual sheets is contained in the transport unit 304. As soon as the predetermined number of dual sheets is contained in the unit 304, these dual sheets are advanced, in one clock cycle, to a subsequent transport unit, which will be described later on.

With regard to the embodiment shown in FIG. 3, reference is made to the fact that the provision of the trap and the resultant double implementation of the brake rolls 322*a* and 322*b* is optional. The trap can e.g. be omitted completely or the dual brake rolls can e.g. be replaced by a single brake roll positioned downstream of the trap.

Furthermore, it is pointed out that, instead of the driven brake roll, a brake roll can also be used which has an increased roll resistance in comparison with conventional rolls so that a suitable deceleration of the second sheet will be achieved, when this brake roll is pressed against a trailing edge of the second sheet.

Making reference to FIGS. 4A to 4C, a first embodiment of the method according to the present invention as well as a second section of the paper handling machine will be explained schematically. The section of the paper handling machine shown in FIG. 4 serves to distribute in a simple way a predetermined number of sheets which are arranged in a transport unit (not shown).

Figure 4A:
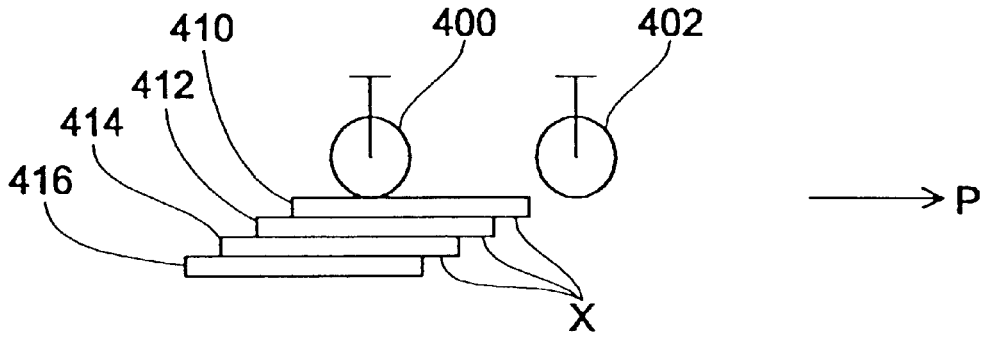
FIGS. 4A–4C shows a schematic representation of the method according to the present invention.

FIG. 4A shows schematically a transport roll 400, which is positioned last in the paper transport direction P, and a distributing roll 402. By way of example, it is assumed that four sheets 410, 412, 414 and 416 are provided in a shingled mode of arrangement. The individual sheets 410 to 416 are arranged in such a way that their edges constituting the leading edges in the paper transport direction P are displaced relative to one another by the distance X.

Figure 4B:
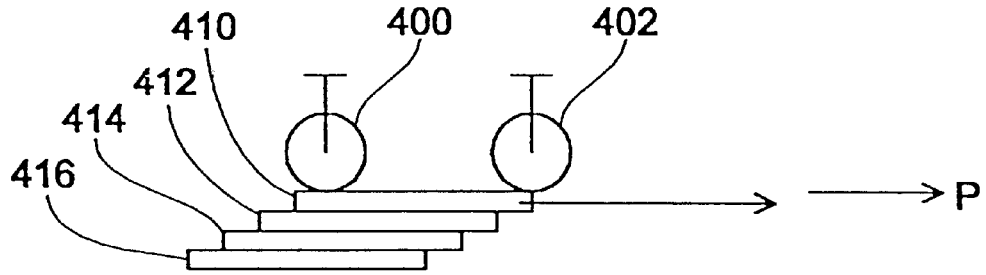

In FIG. 4B, a situation is shown in which only a single sheet, viz. sheet 410, is to be distributed from the stream of sheets shown in FIG. 4A. This is done in that the transport unit causes the stream of sheets to be advanced by a predetermined distance so that only the leading edge of the first sheet 410 is brought into contact with the distributing roll 402. As indicated in FIG. 4B by the arrow, the sheet 410 is discharged from the stream of sheets due to this clocked movement of the sheets and due to the continuous movement of the distributing roll 402.

Figure 4C:
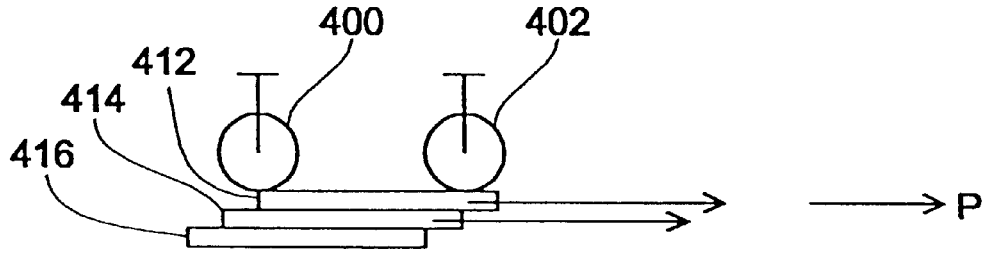

In FIG. 4C, the situation is shown in which a group of sheets, viz. sheets 412 and 414, are to be removed from the stream of sheets; also in this case, the transport unit causes the sheets or rather the stream of sheets to move, the distance of movement being determined by the number of sheets in the group and by the sheet displacement. This clocked movement has the effect that sheet 412, which is now the first sheet in the stream of sheets, is first advanced to the distributing roll 402 and removed by this distributing roll and that, subsequently, the sheet 414 is advanced to the distributing roll 402 and removed as well.

The advantage of this course of action is that, due to the shingled arrangement and due to the method of moving the stream of sheets which has been chosen, it is not necessary to move the sheets by a complete format length in order to distribute e.g. two sheets, but it suffices to bridge only a distance which is essentially determined by the displacement of the sheets arranged.

By means of this method of distributing the individual sheets from the stream of sheets, the grouping of the individual sheets, which has already been shown on the basis of FIG. 1, can be achieved in a simple way, viz. in that, for discharging the individual sheet a, the shingled stream or stream of sheets which has been formed in the meantime is moved by a distance corresponding to the displacement X so that only sheet a will be applied to the distributing rolls 402 in the course of this movement. In the same way, the shingled stream is then moved by a slightly larger distance, this movement being caused by a clock cycle which is slightly longer than the first clock cycle so that the two sheets of group b will be applied successively to the distributing rolls. In the same way, the sheets of group c are distributed in groups.

FIG. 5 shows the section, which has been described schematically on the basis of FIG. 4, in an implementation according to one embodiment. Section 500 comprises a second transport unit 502 and a distributing unit 504.

The second transport unit 502 comprises a pair of guide means 506 and 508 extending from an inlet of the transport unit 502 to an outlet 512 thereof. The transport unit 502 additionally comprises a conveying belt 514, which is adapted to be driven in a clocked mode by a motor, not shown in FIG. 5, and which is supported by two pulleys 516*a* and 516*b*. The pulleys 516*a* and 516*b* are, in turn, secured to a frame 518, as shown schematically in FIG. 5.

Furthermore, four transport rolls 520*a* to 520*d* are provided, which co-operate with the conveying belt 514 and which are arranged such that they are displaced relative to one another by a predetermined distance. The individual transport rolls 520*a* to 520*d* are secured to a chain 522 which is schematically shown in FIG. 5, the chain 522 being, in turn, guided over pulleys 524*a* and 524*b* which are shown schematically as well. As indicated by the arrow 526, the rolls are adapted to be moved in a suitable manner so as to permit an adjustment to different formats. The transport unit described is shown only schematically and it is obvious that the number of rolls and the distance between the rolls depends on the sheets and sheet formats (heights of the printed sheets) used and on the number of sheets to be accommodated. In the figure, an example is shown in which the rolls are spaced apart by 3" (7.62 cm).

The sheets accommodated in the first transport unit, which is shown in FIG. 3, are introduced in the second transport unit 502 as soon as the first transport unit has received therein the maximum possible number of sheets or a predetermined number of sheets. In the transport unit 502, the individual sheets are arranged in a shingled mode of arrangement and they are spaced by a predetermined length of displacement with respect to their respective leading edges in the paper transport direction.

The outlet 512 of the second transport unit 502 is followed by the distributing unit 504 with its inlet 528, a stopper means 530 being provided immediately after the inlet 528; the stopper means 530 is secured to a section of the frame 532 of the distributing unit 504.

With the aid of the stopper means a group of sheets can be stopped or placed ready. When the subsequent paper handling machine, e.g. the collecting station, is ready to receive sheets, and when the sheets have been placed ready at the stop point or stopper means, the path into the collecting station will be shorter, whereby the performance can be increased still further. As a further example, it will assumed that an enveloping unit is arranged subsequent to the paper handling device. While a group of sheets or individual sheets contained in this enveloping unit is/are being put in an envelope by means of this enveloping unit, no further sheets are distributed to the enveloping unit. In this situation, the next group to be processed or the next sheet to be processed can already be moved by the stopper means in the direction of the outlet of the paper handling machine and placed ready at the stopper so that, when the enveloping unit is ready to accept the next group or the next sheet, the path to be bridged will be shorter than in cases in which this group or sheet is supplied from the second transport unit so that a faster supply will take place.

Furthermore, the stopper means provides, alternatively to or in addition to the first-mentioned, above-described functionality of the stopper means, the possibility of "buffering" (intermediately storing) a group while the shingled stream is being transferred from the first transport unit to the second transport unit in the example shown in FIG. 6A. Hence, the slightly longer intermediate clock cycle, which may be necessary for the transfer, will not reduce the performance.

A pair of sensor rolls 534*a* and 534*b*, by means of which the sheets passing between these two rolls 534*a* and 534*b* are counted, is arranged after the stopper means 530, when seen in the paper transport direction P. The counting is carried out such that, by means of the sheets passing, a certain space is caused between the two rolls 534*a* and 534*b*; this space causes, in turn, a displacement of the signalling lever 536 relative to an inductive measuring element 538, whereby a change of inductance will be caused on the basis of which the number of sheets passing between the rolls 534*a* and 534*b* can be detected. In an alternative embodiment, the sensor can also be arranged in front of the outlet 512.

The distributing rolls 540*a* and 540*b* are positioned after the rolls 534*a* and 534*b*, when seen in the paper transport direction P; these distributing rolls 534*a* and 534*b* are driven continuously via motors, which are not shown in FIG. 5, at a predetermined speed which ranges from 2 m/s to 5 m/s, and which is preferably approx. 4.75 m/s. The rolls 534 and 540 are secured to the frame 532 of section 504. The distributing rolls 540*a*, 540*b* and the last transport roll 520*d* are spaced apart by a distance which guarantees that the sheet will be engaged by the distributing rolls when the shingled stream is moved. The distance between the rolls is smaller than the smallest possible height of the printed sheet (format length or length of a sheet measured in the paper transport direction). In the case of a format length of 3.5" (8.89 cm) the distance will be 3" (7.62 cm) so that the sheet will reliably be seized by the next roll when the transport is being continued.

When section 500 is in operation, it is first determined how many of the sheets contained in the transport unit 502 are to be distributed to a subsequent processing means during one clock cycle. Depending on the number of sheets to be distributed, the distance by which the shingled stream arranged in the transport unit 502 is to be moved in the direction of the distributing unit is determined, and this movement is then carried out, the distributing rolls 540*a* and 540*b* removing the sheet of the shingled stream constituting the respective leading sheet in the paper transport direction, i.e. if e.g. only a single sheet is to be removed from the shingled stream, the shingled stream will be moved in a suitable manner by the transport unit 502 in such a way that only the leading sheet of these sheets is placed ready for distribution by the distributing rolls 540*a* and 540*b* so that, during this cycle, only this single sheet will be distributed. If a plurality of sheets, e.g. three sheets, is to be distributed, the shingled stream will be moved for a period of time which is slightly longer than the clock duration required for distributing a single sheet, but which is markedly shorter than the time required for distributing two separate sheets, so that, in this case, sheets arriving in succession at the distributing rolls will be supplied to the subsequent processing unit. In this way, a group is placed ready within a period of time that is much shorter than the period of time which is normally necessary for supplying e.g. three individual sheets for a group to a subsequent processing unit.

Depending on the number of sheets to be distributed, i.e. on the size of the group, the sheets are accelerated more strongly so as to achieve the highest possible speed when they are being distributed.

In FIG. 6A the whole paper handling machine 600 is shown, and, as can be seen, this paper handling machine is composed of section 300 and section 500, section 500 following section 300 in the paper transport direction P. Instead of the configuration of the paper handling machine shown in FIG. 6A, other configurations are, however, possible as well.

FIG. 6B shows a further embodiment of the paper handling machine 602 in which the transport units 304 and 502 are arranged in parallel between the inlet unit 302 and the distributing unit 504. A deflection means 604 is arranged between the inlet unit 302 and the two transport units 304 and 502, this deflection means being effective for supplying dual sheets first to one of the two transport units. As soon as the predetermined or the maximum possible number of sheets has been accommodated in one of the transport units, the deflection means will be switched over to the other of the two transport units and the dual sheets will be supplied to the further transport unit in continuous form. Simultaneously, the operation of the first transport unit is changed over from a continuous to a clocked mode of operation, and the predetermined number of sheets is advanced via the device 606 to the distributing unit 504 in groups and in a clocked mode, as has been described hereinbefore.

In addition to the embodiments of the transport units described in the preceding figures, other realizations are possible as well, especially also in connection with the adjustment of the respective formats.

Making reference to FIG. 7, further embodiments of transport units and of format adjustments will be described in detail in the following.

Figure 7A:
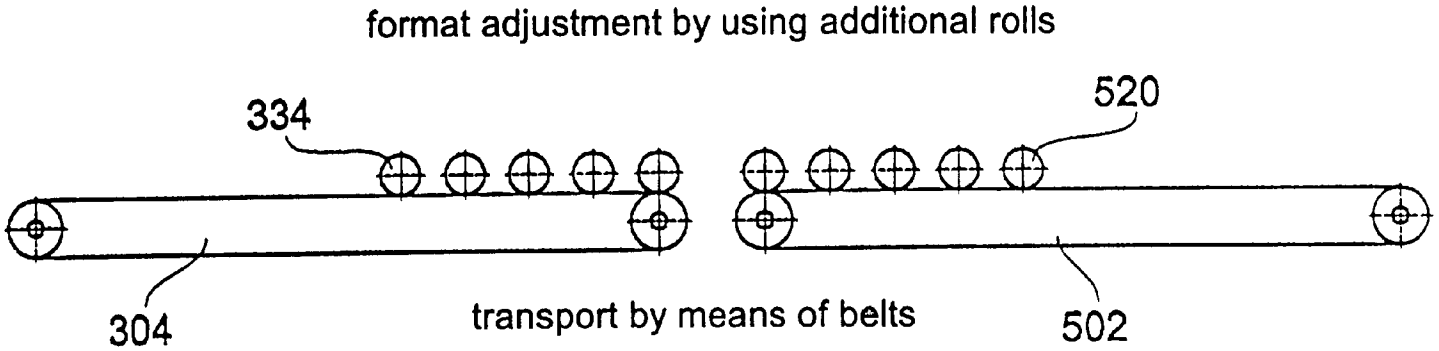

In FIG. 7A, two transport units 304 and 502 are shown, the respective adjustment of the formats being achieved by a suitable increase in and reduction of the number of shingle rolls 334 and transport rolls 520. Depending on the respective format, a higher or smaller number of rolls is used.

Figure 7B:
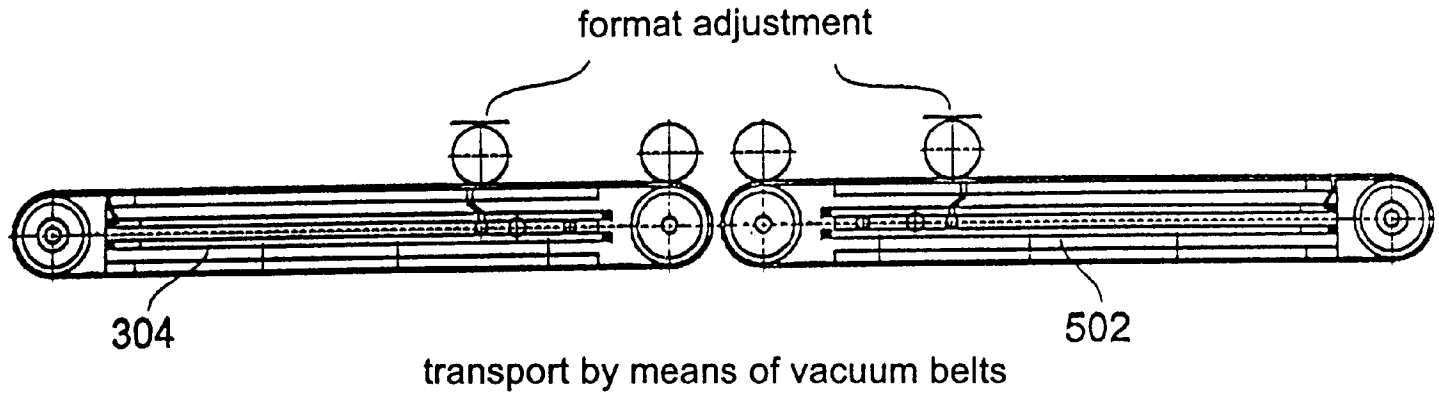
Figure 7C:
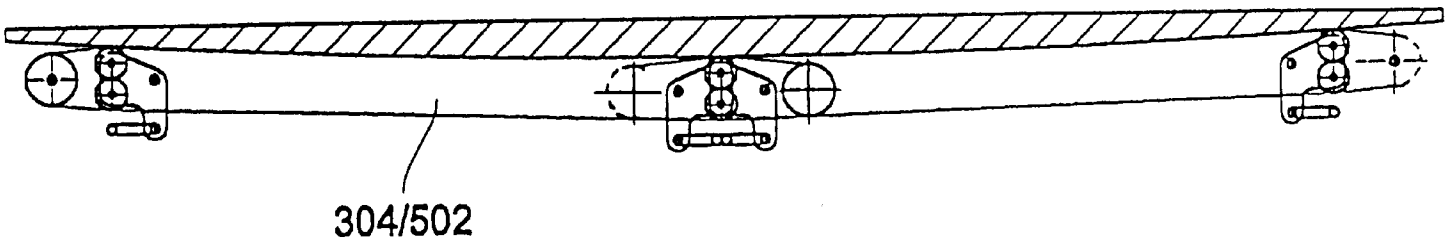
Figure 7D:
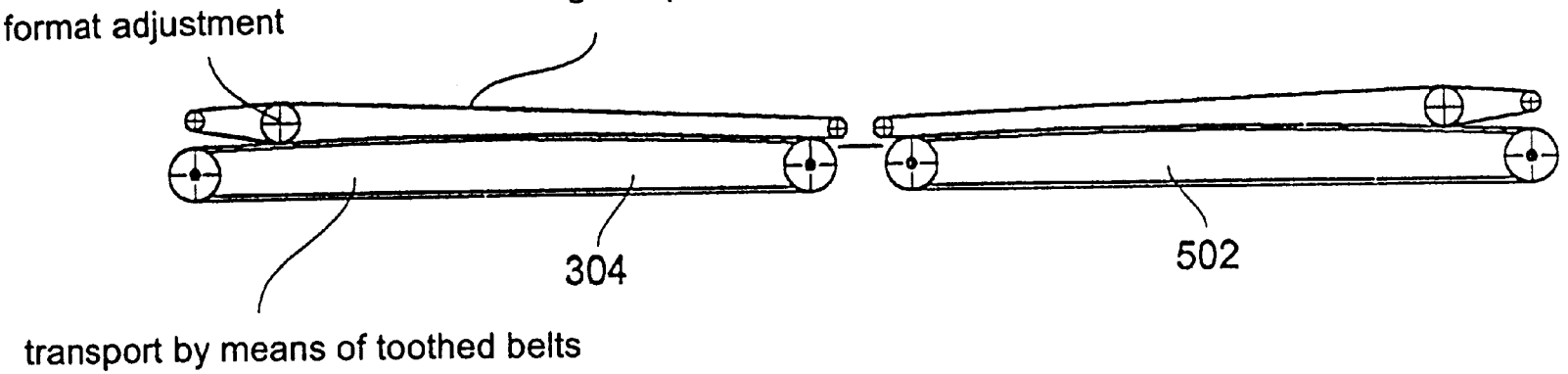

In FIG. 7B, the transport units 304 and 502 are shown, the conveying belts being in this case realized by so-called vacuum belts. In FIG. 7C, a further embodiment is shown, in which the transport units 304 and 502 are formed integrally. FIG. 7D shows a further embodiment for format adjustment.

As can clearly be seen from the above description, this device achieves, in comparison with the devices known from the prior art, a plurality of advantages by means of pre-shingling, continuous feeding and the clocked discharge.

The 2-up printed sheets are placed one on top of the other with a small longitudinal length of displacement so that these sheets are pre-shingled and can easily be separated from one another later on. When larger groups are formed, a larger shingled stream will be formed by the additional, pre-shingled sheets. In the case of the machines known from the prior art, this is only possible with individual sheets or with non-displaced 2-ups. Displaced, i.e. pre-shingled sheets would slide over one another in such machines. As has been described hereinbefore, this problem is solved by decelerating the leading sheet at the leading edge thereof and the trailing sheet at the trailing edge thereof. For advancing the group, the shingled stream is moved to a subsequent transport device which takes over the group, the distance by which the shingled stream is moved being equal to the number of sheets multiplied by the shingle length.

The above-described paper handling machine permits a continuous feed of merged sheets and, consequently, a high increase in performance, since even if groups are separated within the merged sheets, these merged sheets can be distributed together by the precursor. Hence, only one clock cycle is necessary. This permits the use of continuously operating precursors, e.g. rotary cutters and the like, which means that the performance will be increased still further.

As has been described hereinbefore, a paper handling machine, which comprises essentially an inlet transport device with a brake, a trap, a shingle transport device, and a distributing transport device, is defined according to one embodiment of the present invention; the various devices have been described hereinbefore making reference to the figures. The inlet transport device provided with a brake serves to prevent the incoming sheets from slipping and from being damaged, and, as has already been described as well, the shingle transport devices can be arranged in two planes and they are adapted to be operated independently of one another.

When the above-described paper handling systems are in operation, a paper web is first cut longitudinally and transversely in a cutter (FIG. 1). The sheets cut in this way are transferred to the merger (FIG. 1) in pairs and in juxtaposed relationship with one another, the merger superimposing the sheets such that they are slightly displaced relative to one another in the longitudinal direction.

The sheets superimposed (merged) by the precursor are taken over by the inlet transport device 302 of the paper handling machine with a small longitudinal displacement of approx. 20 mm. The leading edge of the leading sheet is decelerated at the shingle roll 334*a*, the trailing sheet is decelerated at the trailing edge. This prevents the sheets from sliding over one another. Depending on the position of the trap 314, further "dual sheets" are shingled selectively in an ascending or descending mode and transported continuously into the transport unit 304 of the buffer until the path has been filled completely.

In the embodiment described on the basis of FIG. 6A, the transport units and the buffers, respectively, are arranged one after the other, the newly formed shingled stream in the first transport unit 302 being fully transferred from the first transport unit to the second transport unit in an intermediate clock cycle, when a predetermined number of sheets has been reached and when the second transport unit has been emptied.

In the arrangement shown in FIG. 6B, the change-over means 604 is activated when the full state of the first transport unit 302 has been reached so that, while the sheets are now entering the second plane in the above-described way, the first plane is emptied in a clocked mode.

Due to the fact that the individual sheets are displaced relative to one another in the longitudinal direction, individual sheets or whole groups of sheets can be transferred to the distributing transport device 504 in the correct sheet sequence by means of a short feed or a longer feed (clock cycle). This distributing transport device will then transfer the group e.g. to a collecting station, in which the sheets are jogged longitudinally and transversely so as to position them precisely on top of one another. Following this, the group is transferred to a subsequent device, e.g. a folder or an enveloping machine.

The advantages of the present invention are that a very high sheet performance can be achieved, since sheets can be taken up continuously, without any necessity of paying attention to group changes. Another advantage is that the preceding and the subsequent machines can be operated independently of one another, i.e. the cutter and the collecting station do e.g. not mutually retard one another. Due to the fact that the sheets are arranged in a shingled mode of arrangement, they can easily be separated from one another and groups can easily be formed.

According to the present invention, fast grouping at a low speed can be achieved due to the pre-shingled sheets. Differences in the performance do not exist in the case of groups which are arranged in pairs or not in pairs, large groups can be handled in an only slightly longer clock cycle, a start-stop operation of the cutter is avoided so that a higher sheet performance will be obtained, and the operational risks are not high in view of the comparatively low transport speeds.

What is claimed is:

1. A method for distributing a plurality of sheets from a group of sheets, said group of sheets comprising a plurality of sheets which are arranged in a shingled mode of arrangement in a sheet transport direction in such a way that leading edges of the sheets in the sheet transport direction are spaced apart in the group by a certain length of displacement, said method comprising the following step:

(a) moving the group of sheets in the sheet transport direction by a predetermined distance which depends on the number of sheets to be distributed and on the sheet displacement, wherein a respective sheet constituting the leading sheet in the sheet transport direction is distributed from the group of sheets as soon as the respective leading sheet has reached a distributing unit as a result of the movement, said distributing unit being driven continuously at least during the movement in step (a).

2. A method according to claim 1, wherein step (a) comprises the following steps:

(a.1.) determining the distance in dependence upon the number of sheets to be distributed and the sheet displacement; and (a.2.) driving a transport unit for a predetermined period of time which depends on the distance deter-mined in step (a.1.);

wherein the distributing unit is driven continuously.

3. A method according to claim 1 or 2, comprising the following step:

(b) repeating step (a) so as to distribute further individual sheets or groups of sheets.

4. A method according to claim 1, wherein the number of distributed sheets is detected.

5. A method according to claim 1, wherein the group of sheets is moved at a speed of 0.25 m/s and the respective leading sheet is distributed at a speed of 4.75 m/s.

6. A device for distributing a plurality of sheets from a group of sheets from a sheet handling machine, said group of sheets comprising a plurality of sheets which are arranged in a first transport unit in a shingled mode of arrangement in a sheet transport direction in such a way that leading edges of the sheets in the sheet transport direction are spaced apart in said group by a certain length of displacement, wherein the transport unit moves the group of sheets in the sheet transport direction by a predetermined distance in the direction of the distributing unit, said predetermined distance depending on the number of sheets to be distributed and on the sheet displacement, and wherein the distributing unit is continuously driven at least as long as the group of sheets is being moved by the transport unit, and wherein said distributing unit distributes from the group of sheets a respective leading sheet in the sheet transport direction as soon as the respective leading sheet has reached the distributing unit as a result of the movement.

7. A device according to claim 6, wherein the transport unit comprises a conveying belt driven in a clocked mode and a plurality of shingle rolls which are pretensioned towards the conveying belt and which are spaced apart in the sheet transport direction by a distance determined by the sheet format and the sheet displacement.

8. A device according to claim 6, comprising a means which is used for transferring to the sheet handling machine at least two sheets arranged in a shingled mode of arrangement in the sheet transport direction and which includes a second transport unit which, after the transfer, moves the at least two sheets at a first speed, a first and a second sheet of the at least two sheets being spaced by a length of displacement in the sheet transport direction (P), said means comprising:

a feed roll which fees the at least two sheets to the sheet handling machine at a second speed, said second speed being higher than the first speed; and a brake roll which decelerates the second sheet to a third speed as soon as the first sheet is decelerated by the transport unit, the third speed being lower than the second speed.

9. A device according to claim 6, wherein the second transport unit comprises a first shingle roll which en-gages the edge of the first sheet constituting the leading edge in the sheet transport direction, and wherein the brake roll engages the edge of the second sheet constituting the trailing edge in the sheet transport direction, as soon as the shingle roll has engaged the first sheet.

10. A device according to claim 8 comprising a trap, which is arranged between the feed roll and the first shingle roll, the trap causing descending shingles of sheets in a first position and ascending shingles of sheets in a second position.

11. A device according to claim 10, wherein the brake roll is associated with a first sheet path along which the at least two sheets travel when the trap is at the first position, an additional brake roll being provided, which is associated with a second sheet path along which the at least two sheets travel when the trap is at the second position.

12. A device according to claim 6, wherein the distributing unit (504) includes a counter which detects the number of sheets distributed.

13. A device according to claim 8, wherein the second transport unit is arranged in front of the first transport unit when seen in the sheet transport direction (P).

14. A device according to claim 8, wherein the second transport unit is arranged such that it extends parallel to the first transport unit, said device comprising the following additional feature:

a deflection means which is arranged in front of the first and second transport units when seen in the sheet transport direction (P) and which conducts sheets to first transport unit when occupying a first position and sheets to the second transport unit when occupying a second position, said deflection means switching over from said first to said second position, when a predetermined number of sheets has been received in the respective transport unit.

15. A device according to claim 8, wherein the third speed is equal to the first speed.

16. A device for distributing a plurality of sheets from a group of sheets from a sheet handling machine, said group of sheets comprising a plurality of sheets which are arranged in a first transport unit in a shingled mode of arrangement in a sheet transport direction in such a way that leading edges of the sheets in the sheet transport direction are spaced apart in said group by a certain length of displacement, wherein the transport unit moves the group of sheets in the sheet transport direction by a predetermined distance in the direction of the distributing unit, said predetermined distance depending on the number of sheets to be distributed and on the sheet displacement, wherein the distributing unit is continuously driven at least as long as the group of sheets is being moved by the transport unit, and wherein said distributing unit distributes from the group of sheets a respective leading sheet in the sheet transport direction as soon as the respective leading sheet has reached the distributing unit as a result of the movement, wherein the transport unit comprises a conveying belt driven in a clocked mode and a plurality of shingle rolls which are pretensioned towards the conveying belt and which are spaced apart in the sheet transport direction by a distance determined by the sheet format and the sheet displacement, and comprising a means which is used for transferring to the sheet handling machine at least two sheets arranged in a shingled mode of arrangement in the sheet transport direction and which includes a second transport unit which, after the transfer, moves the at least two sheets at a first speed, a first and a second sheet of the at least two sheets being spaced by a length of displacement in the sheet transport direction (P), said means comprising:

a feed roll which fees the at least two sheets to the sheet handling machine at a second speed, said second speed being higher than the first speed; and a brake roll which decelerates the second sheet to a third speed as soon as the first sheet is decelerated by the transport unit, the third speed being lower than the second speed.

* * * * *